US012448779B2

(12) United States Patent
Kowalewski

(10) Patent No.: US 12,448,779 B2
(45) Date of Patent: Oct. 21, 2025

(54) BRACKETS FOR ATTACHMENT OF POSTS TO JOISTS

(71) Applicant: James Kowalewski, Baltimore, MD (US)

(72) Inventor: James Kowalewski, Baltimore, MD (US)

( * ) Notice: Subject to any disclaimer, the term of this patent is extended or adjusted under 35 U.S.C. 154(b) by 396 days.

(21) Appl. No.: 18/097,407

(22) Filed: Jan. 16, 2023

(65) Prior Publication Data

US 2023/0279666 A1 Sep. 7, 2023

Related U.S. Application Data

(63) Continuation-in-part of application No. 17/011,684, filed on Sep. 3, 2020, now Pat. No. 11,572,696.

(60) Provisional application No. 62/895,408, filed on Sep. 3, 2019.

(51) Int. Cl.
*E04F 11/18* (2006.01)

(52) U.S. Cl.
CPC ..... *E04F 11/1812* (2013.01)

(58) Field of Classification Search
CPC ..... E04F 11/1812; E04F 11/1817; E04F 2011/1819; E04H 17/009; E04H 17/20; E04H 17/22; E04H 17/23
See application file for complete search history.

(56) References Cited

U.S. PATENT DOCUMENTS 2,667,317 A * 1/1954 Trebules ..... H01Q 1/084 52/298
3,615,110 A * 10/1971 Fugate ..... F16B 7/00 403/230
4,260,277 A * 4/1981 Daniels ..... F16B 9/052 52/370
4,359,851 A * 11/1982 Daniels ..... E04F 11/1812 52/298
4,644,713 A * 2/1987 Lehman ..... E02D 5/80 52/165
4,910,939 A * 3/1990 Cavanagh ..... E04B 1/2604 403/171
5,150,982 A * 9/1992 Gilb ..... E01D 19/103 52/712
5,186,571 A * 2/1993 Hentzschel ..... E04H 17/1413 403/231
5,374,024 A * 12/1994 Williams ..... F16M 11/046 248/514

(Continued)

FOREIGN PATENT DOCUMENTS

CN 110306658 A * 10/2019 ..... E04B 1/2403
CN 113062457 A * 7/2021

(Continued)

*Primary Examiner* — Jonathan P Masinick
(74) *Attorney, Agent, or Firm* — Andrew C. Aitken

(57) ABSTRACT

A mounting device for a deck post in the shape of a square tubular member polygonal planar side elements and one or more an attachment members extending from the top of the tubular member and which form grooves that are sized and spaced to receive structural joists, and at least one sidewall having a top ledge for the support of decking, and at least one retaining tab extending perpendicular from the bottom edge of the tubular members to retain a post member inserted into the tubular member.

12 Claims, 10 Drawing Sheets

(56) References Cited

U.S. PATENT DOCUMENTS

| | | | | | |
|---|---|---|---|---|---|
| 5,568,909 | A * | 10/1996 | Timko | E04H 12/2269 | 52/298 |
| 5,771,646 | A * | 6/1998 | DeSouza | E04F 11/1812 | 52/715 |
| 6,378,819 | B1 * | 4/2002 | Johnson | B62D 49/02 | 248/539 |
| 7,134,636 | B2 * | 11/2006 | Callies | E04H 12/2269 | 248/300 |
| 7,788,873 | B2 * | 9/2010 | Leek | E04B 1/2608 | 52/712 |
| 8,141,830 | B1 * | 3/2012 | Hudson | E04G 21/1808 | 33/408 |
| 8,834,057 | B2 * | 9/2014 | Adams, Jr. | F16B 7/0493 | 403/233 |
| 8,870,163 | B2 * | 10/2014 | Regan | E04F 11/1812 | 52/298 |
| 8,959,849 | B1 * | 2/2015 | DiGirolamo | E04B 1/003 | 52/715 |
| 9,388,540 | B2 * | 7/2016 | Koering | E04G 5/14 | |
| 10,174,498 | B2 * | 1/2019 | Winter | E04B 1/388 | |
| 2003/0196394 | A1 * | 10/2003 | Hoffman | E02D 27/02 | 52/704 |
| 2007/0108364 | A1 * | 5/2007 | Metheny | E04F 10/04 | 248/541 |
| 2011/0308063 | A1 * | 12/2011 | Feeleus | E04B 1/26 | 403/376 |

FOREIGN PATENT DOCUMENTS

| | | | | |
|---|---|---|---|---|
| DE | 202014000276 | U1 * | 6/2014 | E04B 1/003 |
| KR | 101364518 | B1 * | 2/2014 | |
| KR | 20210123565 | A * | 10/2021 | |

* cited by examiner

BRACKETS FOR ATTACHMENT OF POSTS TO JOISTS

The Applicant claims the benefit of the filing date of U.S. Pat. No. 62,895,408 filed Sep. 3, 2019 and U.S. Pat. No. 17,011,684 filed on Sep. 3, 2020.

FIELD OF THE INVENTION

The present disclosure is generally related to structural brackets for buildings, and specifically, to brackets for installing rail systems to both residential and commercial buildings including decks for residential applications.

BACKGROUND OF THE INVENTION

Decks, and other structures with open floorplans having elevated structures and open stairways are often installed in manners that require rails to prevent people from falling off open ledges.

Decks are often attached to the exterior of structures (e.g., houses or commercial buildings) using bolts, screws, or other means attaching a deck ledger board to an exterior structural surface of the building which is then surrounded by a rail.

The primary structural strength of a deck guardrail is provided by posts, which are preferably 6"×6" or larger and extend from the deck foundation or are fastened to both rim joists and end joists at the deck frame perimeter. A manner to ensure that deck railings are strong and secure is to fasten railing posts in a way that resists the lever force exerted at the post base when someone leans against the top rail. The manner this is done will depend on where a post is attached to the deck frame.

There are a number recommended techniques to improve rails strength that include (1) spacing the guardrail posts no further than 6 feet apart; (2) refrain from notching the posts around joists or beams, which diminishes the integrity of the post members; (3) the use of at least two ½-inch bolts or lag screws to fasten the base of each post to the respective face of the joist; (4) the use of metal, deck-post tension ties; and (5) providing wood blocking to counteract forces at post bottoms.

While guardrail requirements in the International Residential Code (IRC) have not materially changed, guardrails have nonetheless received increased attention from code officials, and local building code enforcement is changing and mote rigorous. It has been reported that while the ICR requires guardrails to be much stronger than common industry practices, most traditional methods of mounting posts do meet those strength requirements.

As discussed above, guardrail posts act as levers when a force is applied along the top rail or post. The weak link is not where the bolts hold the post to the rim joist but, rather, it is often where the rim joist attach to other floor joists and the end joists. Nails and screws typically fasten the rim joist into the end grain of the joists, but these fasteners may not provide sufficient hold to resist the posts leverage when a force is applied to the top of the post or top rail. Consequently, in order to construct a strong and code-compliant post-to-joist connection on a wood frame, the use of special metal connectors is typically required. These connectors often are designed to transfer the force on the posts directly to the floor joists. In some arrangements of hardware ties can be used to connect the post and rim joist directly to a transverse floor joist. In other arrangements hardware may reinforce the connection of the rim joist to floor joists on either side of the post.

As discussed above, a further manner to secure posts involves the use of blocking between or alongside joists to prevent posts from dislocation. The blocks and how well they are fastened are critical to the connections because the hardware is screwed to them.

Many manufactured deck railing systems require guardrail posts to be mounted inside the rim joist so post sleeves and base trim rest flat on the decking. But in most cases posts are easier to install outside of the rim joist. There is a way to use outside-the-rim mounted posts with manufactured railing systems by adding a 2-by skirt board outside the posts. One may either mount such a skirt board using the same bolts that mount the posts to the rim and the metal connectors or fasten the skirt board with structural screws after bolting the posts.

FIG. 1 depicts a prior art deck post fastening arrangement for a corner post that includes a post 101 attached with bolts 103 and 105 to transverse floor 107 and rim joist 109. The post is blocked with blocks 115 and 117 which present the post from movement in response to force allied to the top of the posts in both directions parallel with the rim joist and transverse floor joist. This arrangement also includes bracket ties 120 and 121.

FIG. 2 depicts a blocking arrangement for a deck post 202 attached to rim joist 205. This arrangement uses a block 207 that prevents the bottom of the post from movement in a direction perpendicular to the rim joist 205. The post is attached to the rim joist 205 by bolt 210 and transverse joist 207 by bolt 212.

FIG. 3 depicts a deck post attachment arrangement wherein post 301 is attached to an exterior rim joist 305 by a bolt 317 that extends from location 306 through joist 305, post 301 and adjacent joist 310. The post is secured by blocks 311 and 313. The bolt is secured by triangular bracket 315.

FIG. 4 depicts a deck post attachment arrangement wherein the deck post 401 is attached to rim joist 403 using bolt 405. Rim joist 403 is secured to floor joists 408 and 409 by triangular brackets 410 and 411.

A triangular hardware connector bracket, referred to as the DeckLok bracket can be used to mount guard posts. The DeckLok system, depicted in FIG. 5 is a lateral anchor system that secures deck components to the structure of the deck and uses right triangular-shaped steel members 505 and 506 that attach to the joists 510 and 511 and post 515 using bolts. The Deck-Lok system creates deck connections by redirecting the force of the load from pullout to a connection in shear at the deck floor joist.

SUMMARY OF THE INVENTION

The fastening system of the invention includes brackets structures for rail posts that can be installed either at an interior corner at the intersection of a floor joist and rim joist or along either the interior or exterior side of a rim joist. In a first embodiment for mounting a post in a corner of a floor joist and rim, a 6×6 post is received in a square shaped cavity defined four metal plates. At the top of two of these plates a flange section extends laterally and then downward to define a downward facing groove that is sized and shaped to receive the respective floor joist and rim.

The brackets of the invention include flange sections and plate sections that have perforation to allow for the attachment of the bracket to the respective joists and the post. In addition to the plate fasteners, the bracket has four lower tabs that hold and engage the bottom surface of the post. This tab structure allows the user to locate the post in its position before fastening without the use of further temporary structures or tacks.

Brackets of embodiments of the invention includes one or more mounting bolt holes to provide a template for drilling mounting bolt holes into the rim joists and floor joists of the building and holes for other fasteners such as nails or screws.

These and other objects, features and advantages of the present invention will become more apparent upon reading the following specification in conjunction with the accompanying drawing figures.

DETAILED DESCRIPTION OF SPECIFIC EMBODIMENTS

Figure 1:
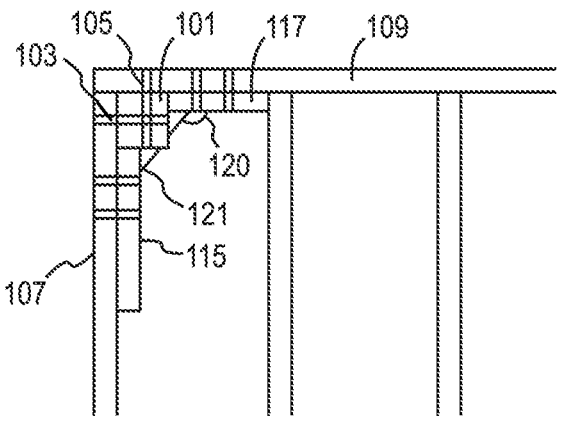
FIG. 1 (Prior Art)
FIG. 1 is top view of a prior art system for post attachment.
Figure 2:
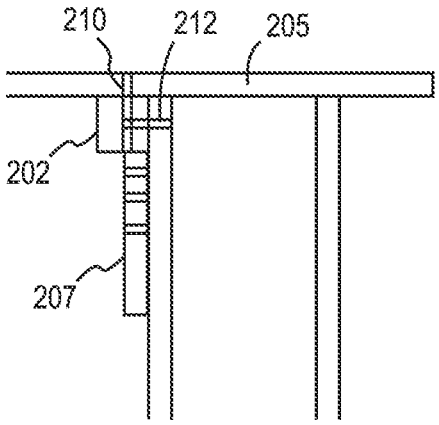
FIG. 2 (Prior art)
FIG. 2 is an alternative top view of a prior at system used for post attachment.
Figure 3:
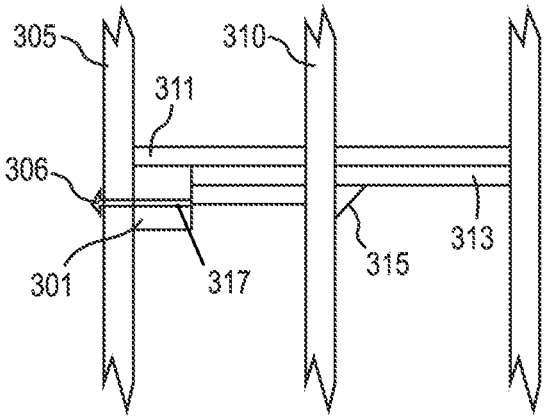
FIG. 3 (Prior art)
FIG. 3 is a top view of another prior view post attachment system.
Figure 4:
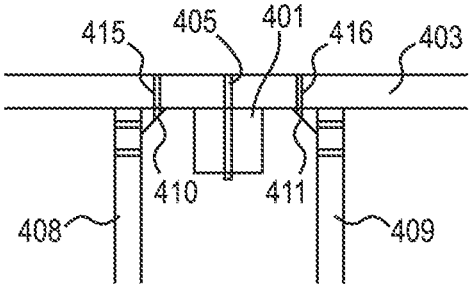
FIG. 4 (Prior art)
FIG. 4 is a top view of a prior view post attachment system.
Figure 5:
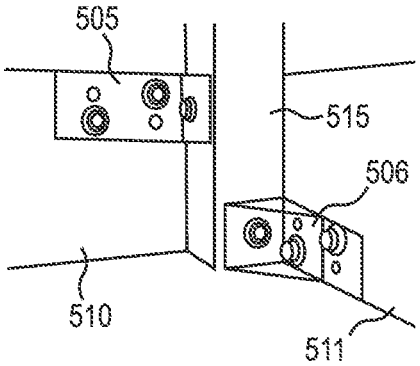
FIG. 5 (Prior art)
FIG. 5 is a perspective view of a prior art device used to secure posts used for deck rails.

Specific embodiments of the invention including methods in which to implement the invention are described herein. Now referring to FIG. 6, bracket 601 is made from a single piece of steel plate and formed into the shape of a square cavity that is defined by plates 605, 607, 609 and 611. Extending from plate 611 is attachment member 615 that includes horizonal element 617 and vertical element 619. Adjacent plate 605 also has a top attachment member 680 including horizontal element 621 and vertical element 623. Plate 605 is provided with extension section 630 which has apertures 632 and 634 that receive fasteners. The apertures are positioned to allow the plate to be attached to adjacent joists. Plate 611 also has an extension region 640 that is designed to engage a second joist and apertures that facilitate the attachment and construction of the post assembly. Apertures 720, 702 and 704 are designed to receive fastener to attach the bracket to a joist.

Figure 7:
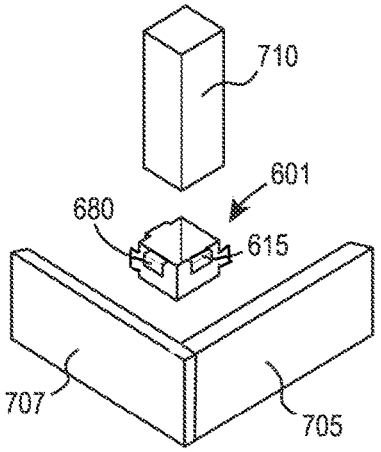
FIG. 7 is an isometric exploded view of the embodiment of FIG. 6 showing the manner in which the bracket engaged with joints and a post.

Now referring to FIG. 7, bracket 601 is shown with post 710 and two joists, floor joist 705 and rim joist 707 that are secured together in a perpendicular arrangement to corm a corner. The bracket flange members 615 and 680 are sized and shaped to engage the top edge of the joists 705 and 707. The bracket serves as a manner to attach the posts and provides an additional manner to secure the rim joist 707 to floor joist 705. In this regard, the rim joist attachment to the floor joists is a location of possible failure because, inter alia, the fasteners from the rim joist 707 are into the end of the floor joist 705 and with the respective to the grain of the wood. The bracket element provides an additional fastener element that serves to securely tie rim joist 707 to the floor joist 705.

Figure 8:
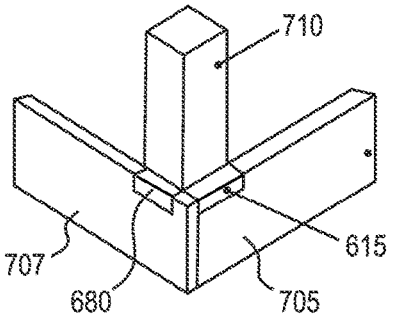
FIG. 8 is an isometric view of the device of FIG. 6 shown in engagement with joists and a post.

Now referring to FIG. 8, the bracket 601 is depicted in engagement with floor joist 705 and rim joist 707. Flange 615 is attached to joist 705 and with the plate member 605 prevents movement along its length. Flange 680 is attached to rim joist 707. The attachment of flange 615 and plate extension section 640 to the floor joist 705 restricts the motion of the bracket in a direction perpendicular to rim joist 707.

Figure 9:
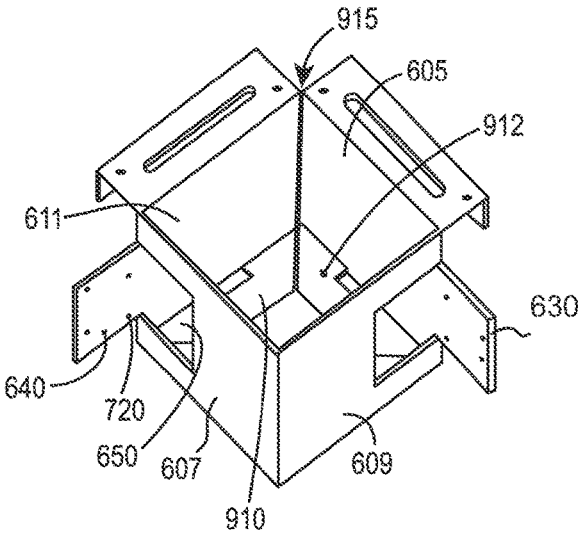
FIG. 9 is an isometric rear view of the embodiment of FIG. 6.
Figure 10:
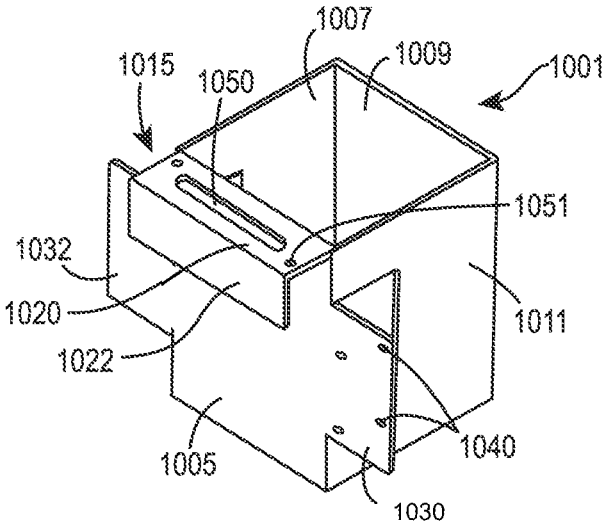
FIG. 10 is an isometric view of a second embodiment of the invention.
Figure 11:
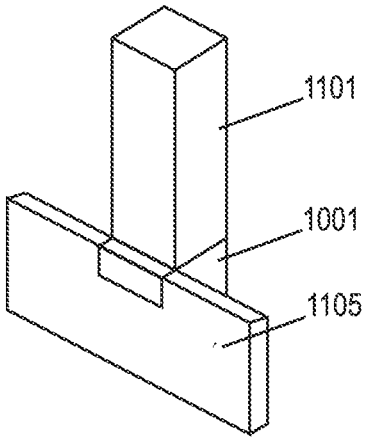
FIG. 11 is a front isometric view of the second embodiment shown attached to a rim joist and post.

FIG. 9 depicts the rear view of bracket 601. From this orientation it can best seen that the plate extension region 640 is formed by cutting into plate 607 and folding it into the same plane as plate 611. As a result, there is a space or void region 650 in plate 607. On the other side, plate extension region 630 is cut from plate 609 and is folded to align in the same plane as plate 605. Also seen from this view are bottom tabs 910 and 912 which extend from the bottom of plates 611 and 605 respectfully. These tabs are designed to engage the bottom of a post and prevent a post from sliding through bracket 601 during assembly with a post FIG. 10 depicts a second embodiment of a bracket 1001 designed to be attached to a lateral side of a joist and may be a rim joist or an end joist. Bracket 1001 may be attached to the inside or outside of the joist. Bracket 1001 defines a square cavity configured to receive a post, such as a 6×6 post, and formed by four plate members 1005, 1007, 1009, and 1011. Plate 1005 includes an attachment member 1015 that is formed by top member 1020, downward extending member 1022 and plate 1005. Plate 1005 has opposite extension areas 1030 and 1032 that have apertures such as apertures 1040 that are designed to received fasteners to allow attachment of the bracket to the side face of a joist. The top flange 1020 is secured to the top of a joist to prevent lateral movement of the bracket in the direction of the joist. A slot 1050 is depicted in member 1020 that allows the user to position a fastener along the length of the attachment member. Aperture holes such as hole 1051 are also provided to fasten the bracket to the top of a joist. When the bracket 1001 is attached to the outside of the joist, the joist itself prevents the bottom of the post from moving in a lateral direction lateral if a force is applied to the top of the rail. When the bracket is attached on the inside of the rim or end joist, such as depicted in FIG. 11 a bolt may be provided though the plate 1005 and or extension areas 1030 and 1032 to restrict the post from motion away from the joist FIG. 11 depicts a post 1101 that has been received in bracket device 1001 and in engagement with joist 1105.

Figure 12:
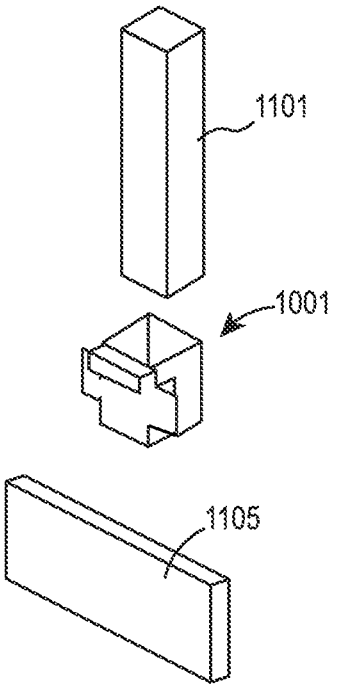
FIG. 12 is an isometric exploded view of the embodiment of FIG. 10 showing the manner in which the bracket is engaged with joist and post.

FIG. 12 depicts and exploded view that shows the positioning of post 1101 before received in bracket 1001 and the manner bracket 1001 is attached to the joist 1105.

Figure 13:
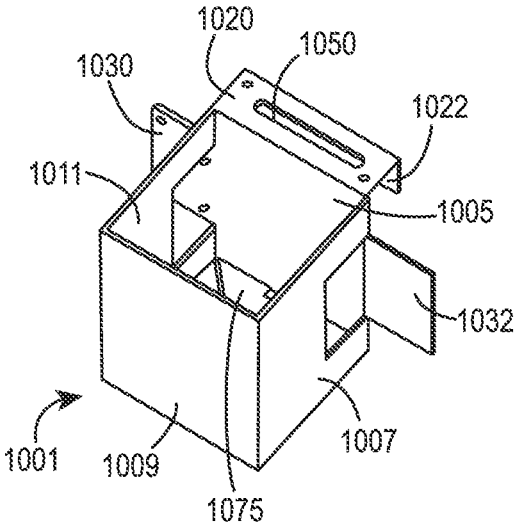
FIG. 13 is a rear isometric view of the embodiment of FIG. 10.

FIG. 13 is a rear view of the bracket 1001 which is comprised of lateral plates 1007, 1009, 1005 and 1011. Like the embodiment of FIG. 6, the bracket has tab extensions at the bottom such as tab 1075 on which the bottom of a post may be received and supported during assembly.

Figure 6:
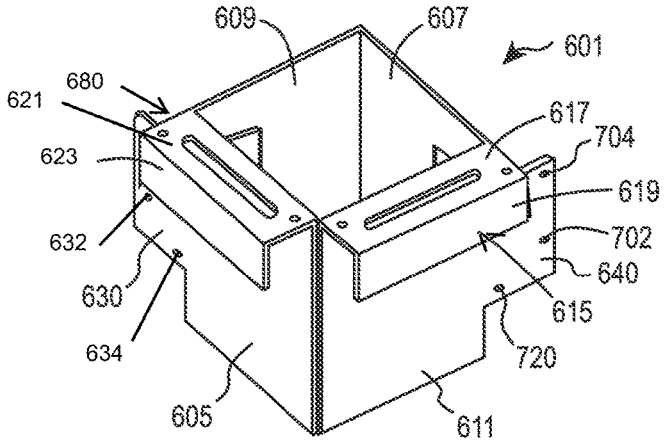
FIG. 6 is an isometric front view of a first embodiment of the invention.
Figure 14:
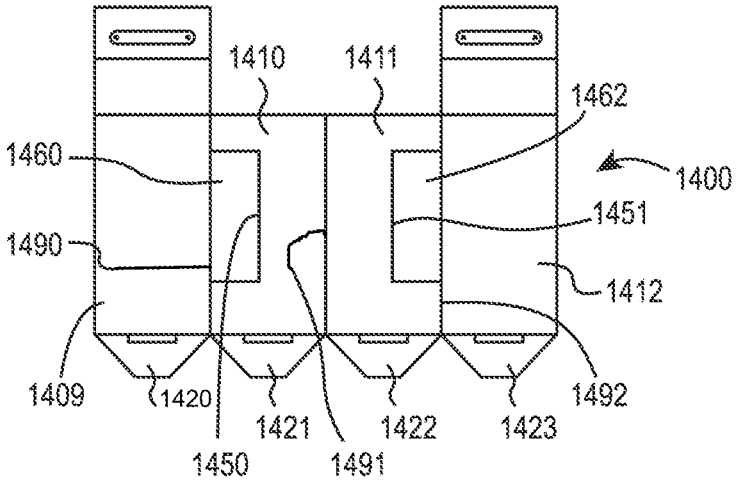
FIG. 14 is a top plan view of the device before it is bent to its three-dimensional shape.

As seen in FIG. 14, the bracket of FIG. 6 may be created from cutting a flat piece of steel 1400 in the configuration depicted. The part is then bent to form a square tubular structure. Each plate section 1409, 1410, 1411 and 1412 includes a tab, 1420, 1421, 1422 and 1423 that are oriented toward the center of tubular suture. These tabs will support the post during assembly. The template also has cut lines 1450 and 1451 to create the extension areas that are used to secure the bracket to the lateral sides of floor joists as described above. Region 1460 is cut from plate 1410 so that when the member is folded along the vertical lines 1490, 1491 and 1492, the section 1460 can be positioned in the same plane as adjacent plate section 1409. A similar cut 1451 allows section 1462 to be positioned in the same plane as section 1412 after folding the member along line 11492.

Figure 15:
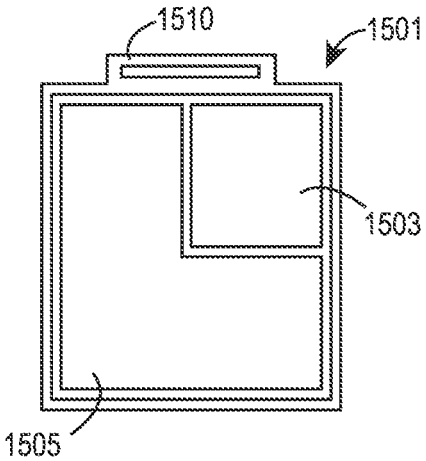
FIG. 15 is a top sectional view of a post received in a corner bracket

Referring now to FIG. 15, a further feature of the invention is to provide manners in which the bracket device can accept different sized and shaped deck-posts. It should be understood that while each of the brackets depict a single flange device designed to engage a rim joist or end joist, it is contemplated that a second flange member may be provided to allow the device to engage perpendicular joints in a corner. Bracket 1501 is shown with a deck post 1503 that is secured in place by insert member 1505. This bracket includes a flange member 1510 that is designed to engage a joist.

Figure 16:
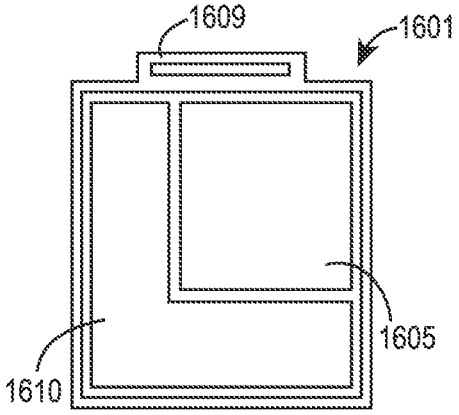
FIG. 16 is a top sectional view of a post received in a corner bracket

Referring now to FIG. 16, a different sized post 1605 is shown in bracket 1601 that is secured in place by insert 1610. The bracket 1601 incudes a flange section 1609 to engage a rim or end joist. Inserts such as insert 1505 and 1610 are hollow and made of HDPE.

Other synthetic resins such as nylon, ABS, HDPE and PVC may be advantageously be used. The inserts may be solid and can be made of other materials including wood, wood pulp and composite materials including wood fibers and synthetic film such as polypropylene and polyethylene. Solid products are available from Trex and Timber-Tech, Veranda, and Fiberon.

Figure 17:
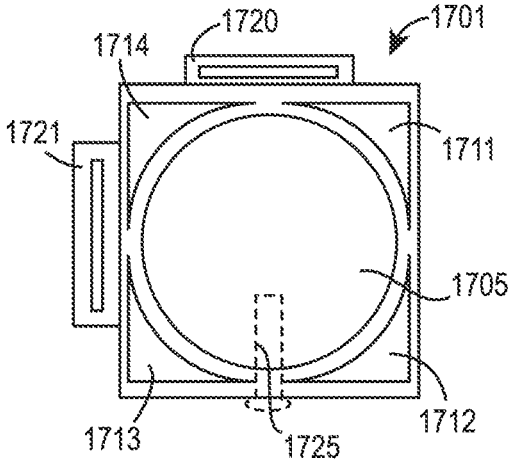
FIG. 17 is a top sectional view of a post received in a corner bracket

FIG. 17 depicts a bracket 1701 into which a deck post 1705 having a circular cross section is received. Bracket 1701 includes flange section 170 and 1721 that are designed to engage joists. The deck post is secured in place to prevent lateral motion by inserts 17111, 1712, 1713 and 1714. The post is secured to the bracket by a fastener 1725. In embodiments a fastener may be inserted through a joist and the respective deck post.

Figure 18:
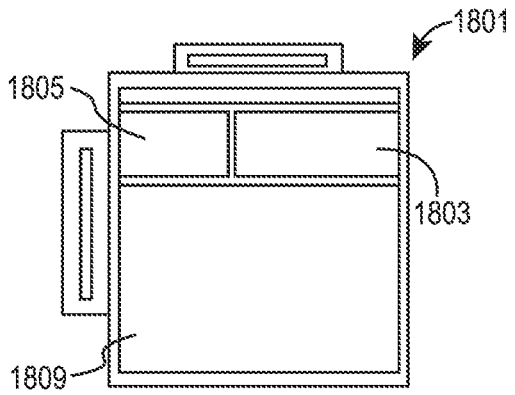
FIG. 18 is a top sectional view of a post received in a corner bracket
Figure 19:
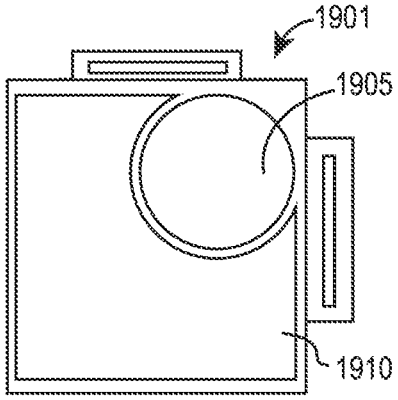
FIG. 19 is a top sectional view of a post received in a corner bracket
Figure 20:
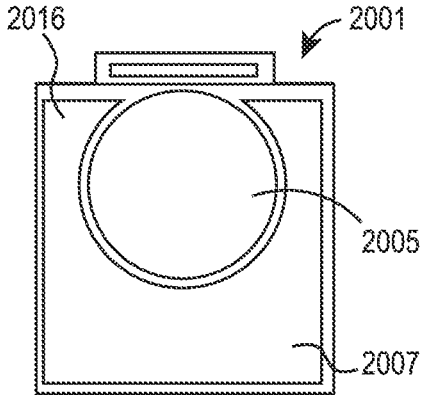
FIG. 20 is a top sectional view of a post received in a side bracket
Figure 21:
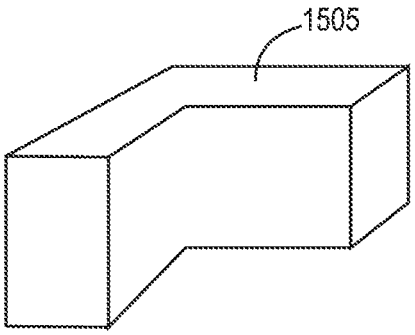
FIG. 21 is a perspective view of an insert configurated to be received in the embodiment depicted in FIG. 15.
Figure 22:
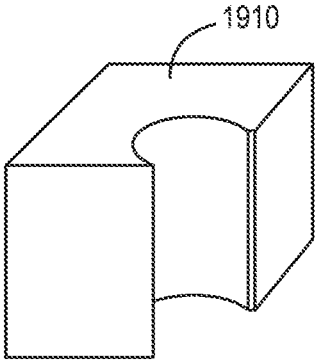
FIG. 22 is a perspective view of an insert configurated to be received in the embodiment depicted in FIG. 22.
Figure 23:
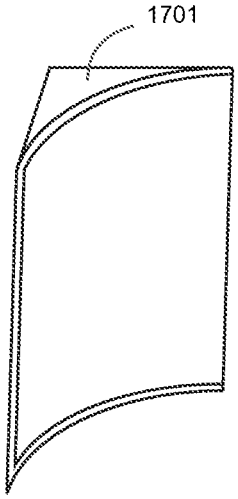
FIG. 23 is a perspective view of an insert configurated to be received in the embodiment depicted in FIG. 17.

In other embodiments a plurality of inserts are provided to secure the deck posts to maintain the post in position. For example, FIG. 18 depicts a bracket 1801 in which a two by four post 1803 that is secured in place by inserts 1805 and 1809. Yet a further embodiment is depicted in FIG. 19 that receives a round post 1905 that is retained in insert 1910 and a further embodiment depicted in FIG. 20 that shows bracket 2001 that retains a round post 2005 along a side 2016 of the bracket 2001 using insert 2007. Exemplary inserts are depicted in FIGS. 21, 22 and 23. The insert 1505 is designed to be received with the bracket 1501 depicted in FIG. 15, insert 1910 is received in bracket 1901 and insert 1712 is received in bracket 1701 of FIG. 17.

Figure 24:
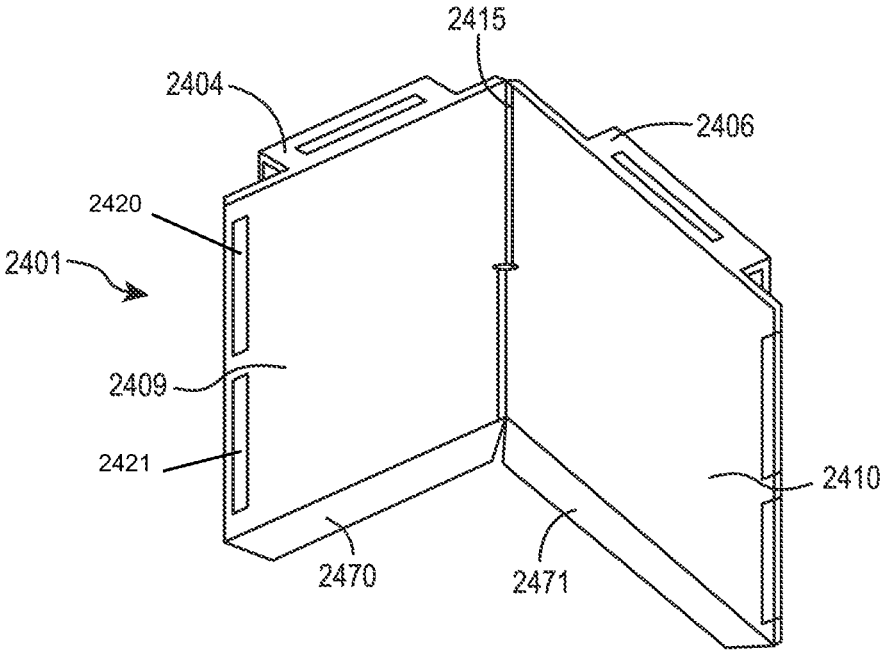
FIG. 24 is a perspective view of a first section of a further embodiment of the invention that uses two hinged sections that may be attached together.
Figure 25:
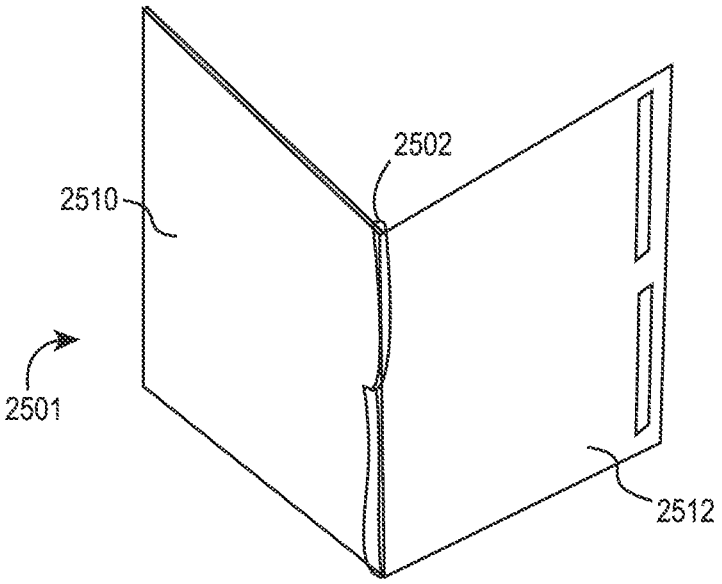
FIG. 25 is a perspective view of the second section used in connection with the embodiment of FIG. 24.
Figure 27:
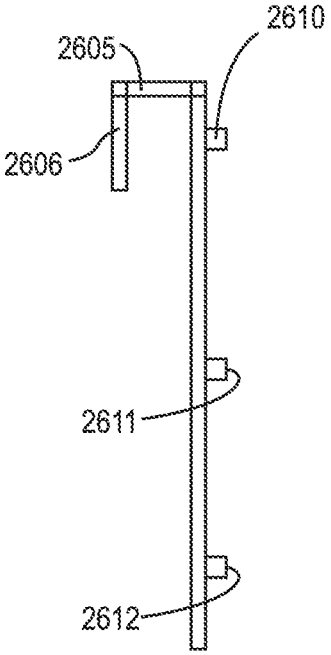
FIG. 27 is a side view in elevation of the first part depicted in FIG. 26.

Referring now to FIGS. 24 and 25, a bracket embodiment with two halves, 2401 and 2501 is depicted. In this embodiment bracket 2401 is attached to rim and end joists using flange elements 2404 and 2406. Bracket 2401 is made up of plates 2409 and 2410 which are attached together by central hinge 2415. Plate 2409 has slot openings 2420 and 2421 that are size and shaped to receive an opposite tab (not shown) that extends from the part 2501 and attaches the parts together. In embodiments the section 2501 is provided with vertical extending lateral portions, on both sides of the hinges plates, bent 90 degrees from the main plate area. The manner of assembly is similar to that described below. In another contemplated embodiment vertical orientated rods are provided on one side of a two part hinged plate assembly and annular cavities, sized and shaped to receive the rods are on an opposite two part hinged plate assembly. Extensions 2470 and 2471 project from the bottom of plates 2409 and 2410 and will support a deck post that is received in the assemble part. FIG. 25 depicts the second part 2501 that is assembled with part 2401 to form a square profile bracket sized and shaped to receive a deck post. It also has a central hinge 2502 that connects plate 2510 and 2512.

Figure 26:
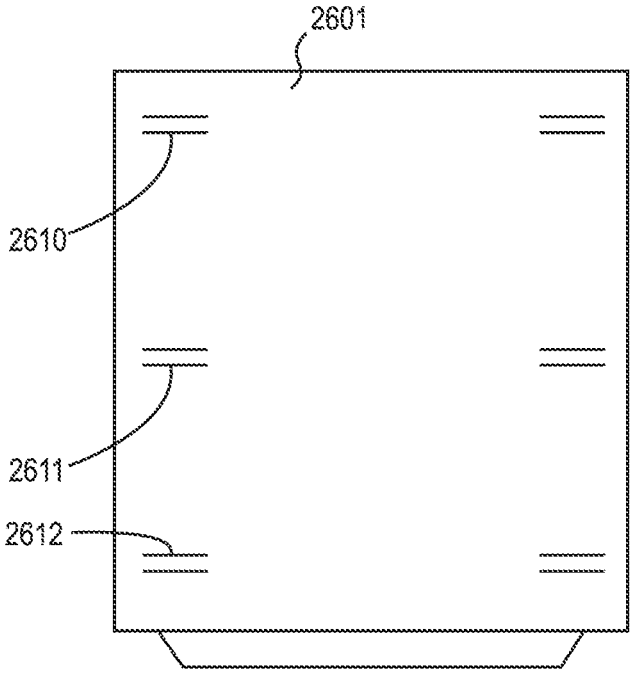
FIG. 26 is a front view in elevation of a first part of a further four-part embodiment.
Figure 33:
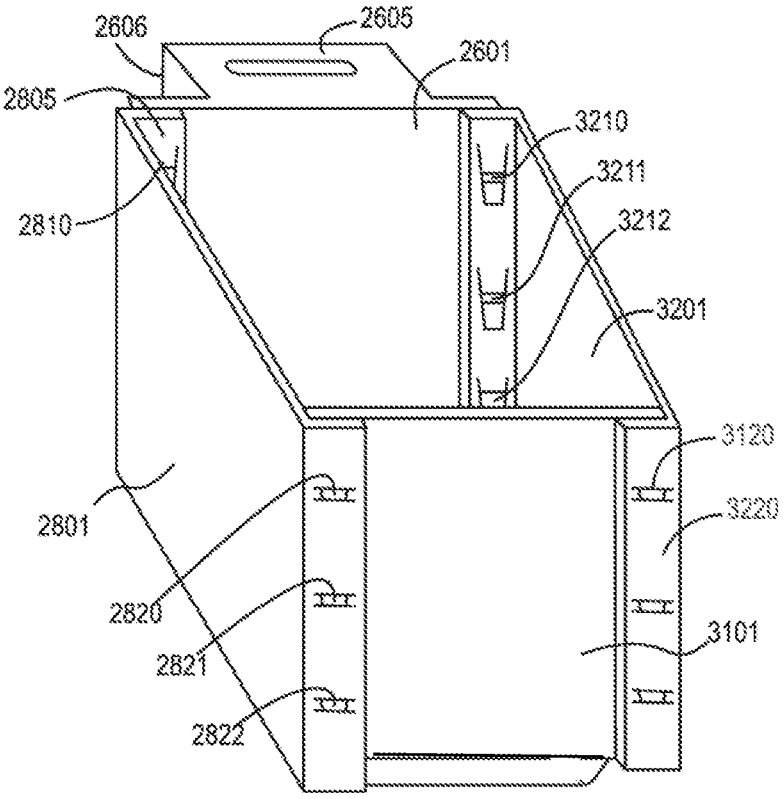
FIG. 33 is a perspective view of a four-part embodiment of the invention.

As seen in FIG. 33, a further embodiment of the invention is created by the assembly of four plates 2601, 2801, 3101 and 3201 to form a square bracket. FIG. 26 depicts plate 2601 which has a series of "pockets" or bands 2610, 2611 and 2612 located on rear surface of the plate. These pockets are formed these by cutting two parallel openings through the plate and bending the pockets between the openings outside of the plane defined by the plate. These pockets are sized to receive a tab that is provide on an adjacent plate. Plate 2601 has three additional pockets 2650, 2651 and 2652 on the opposite side of the plate. At the top of plate 2601 is flange member made up of parts 2605 and 2606 which is sized to engage the top of a rim or edge joist. The pockets of part 2601 receive tabs 2810, 2811 and 2812 as depicted in FIGS. 28 and 30.

Figures 28, 29, 30:
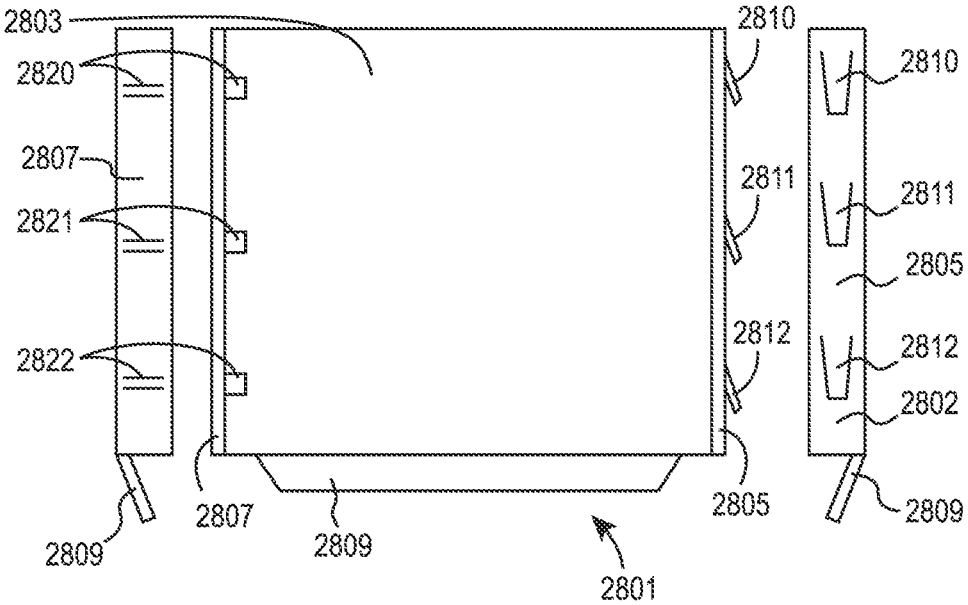
FIG. 28 is a front view in elevation of a second part of the four-part embodiment.
FIG. 29 is an end view in elevation of the second part depicted in FIG. 28.
FIG. 30 is an opposite end view in elevation of the second part depicted in FIG. 28.

Referring now to FIG. 28, side plate 2801 has a central flat section 2803 and opposite sections 2805 and 2807 that are perpendicular to the surface 2803. A tab section 2809 is provided along the bottom surface that is bent inward at a and designed to hold the bottom of a deck post. Section 2805 has three tabs 2810, 2811, and 2812 that are cur from the sheet metal and bent out of the plane defined by element 2805. As best seen in FIG. 30, these tabs generally taper from a wider top section to a narrow bottom section to assist allow insertion into the pockets. Tabs 2810, 2811 and 2812 fit into pockets 2610, 2611 and 2612.

Figure 32:
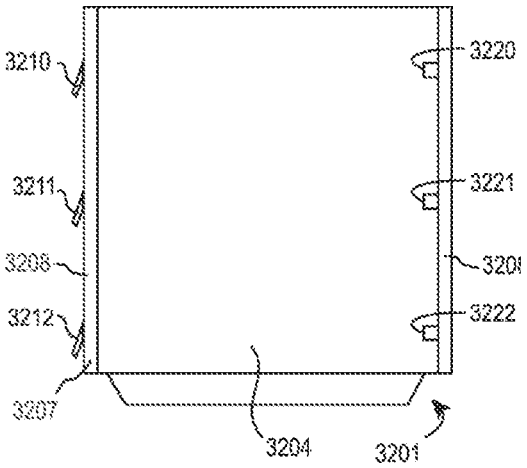
FIG. 32 is a front view in elevation of the fourth part of the four-part embodiment of the invention.

The opposite side 2807 is provided with three pockets 2820, 2821 and 2822 that can engage opposite tabs on rear plate 3101. These pockets are formed like those in the surface of plate 2601 and as seen in FIG. 28 are bet outside of the plane that is defined by surface 2803. Plate 3201 illustrated in FIG. 32 is a mirror copy of plate 2801 and is designed to engage front plate 2601 and rear plate 3101. It includes tabs 3210, 3211 and 3212 and pockets 3220, 3221 and 3222.

Figure 31:
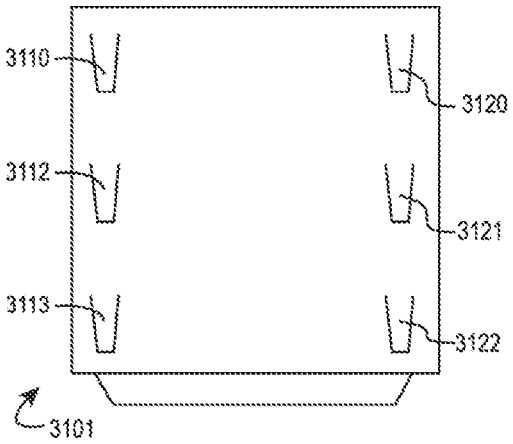
FIG. 31 is front view in elevation of a third part of the four-part embodiment.

Plate 3101 depicted in FIG. 31 is provided on the rear element of FIG. 33 and has tabs 3110, 3112, 3113 on one side and 3120, 3121 and 3122 on the other side. These tabs are created to engage the rear pockets on side plates 2801 and 3201. The plates described are preferably made of galvanized 12-gauge steel. The dimensions of an exemplary embodiment are provided in FIG. 14 wherein the flange element have a length of approximately 1.63 inches and a width of 3.75 inches. Each plate has a width of approximately 3.74 inches to receive a 4"×4" deck post. One skilled in the art would understand that the bracket can be made to other desired dimensions and be made with other materials.

Figure 34:
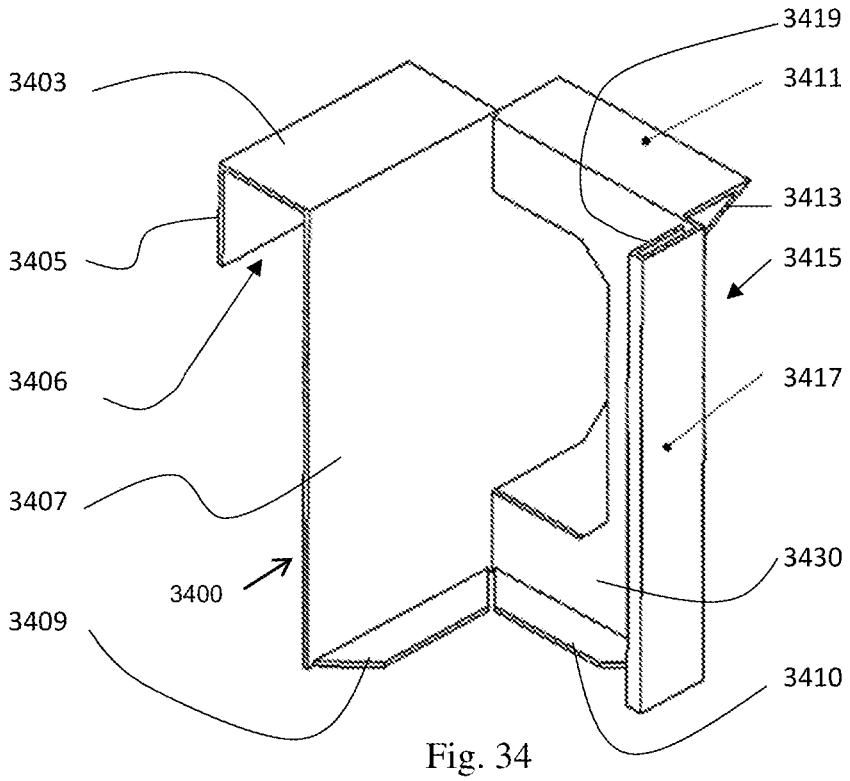
FIG. 34 is a perspective view of a one part of a two-part embodiment of the invention that includes a deck support member and a hem attachment structure.
Figure 35:
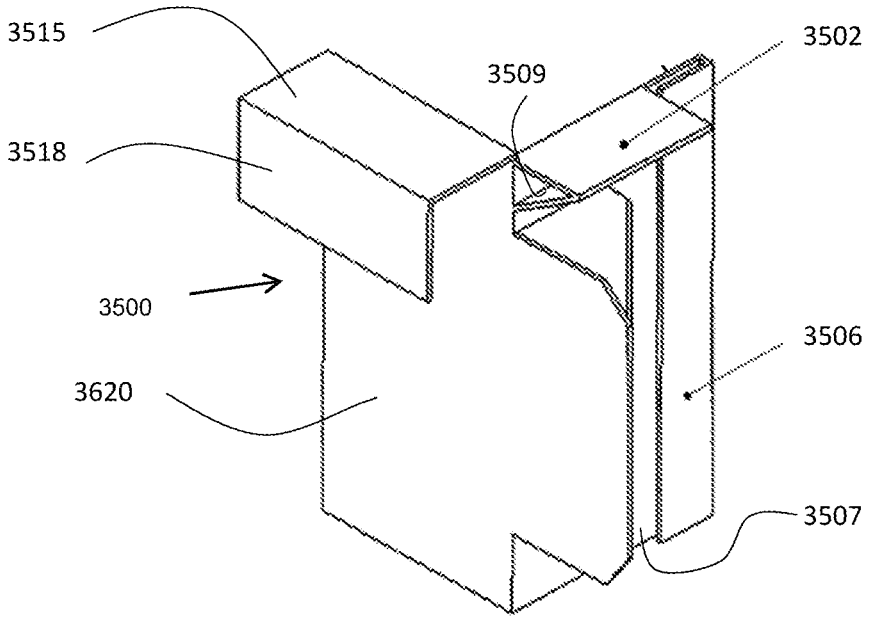
FIG. 35 is a perspective view of a complementary part for the part illustrated in FIG. 34.
Figure 36:
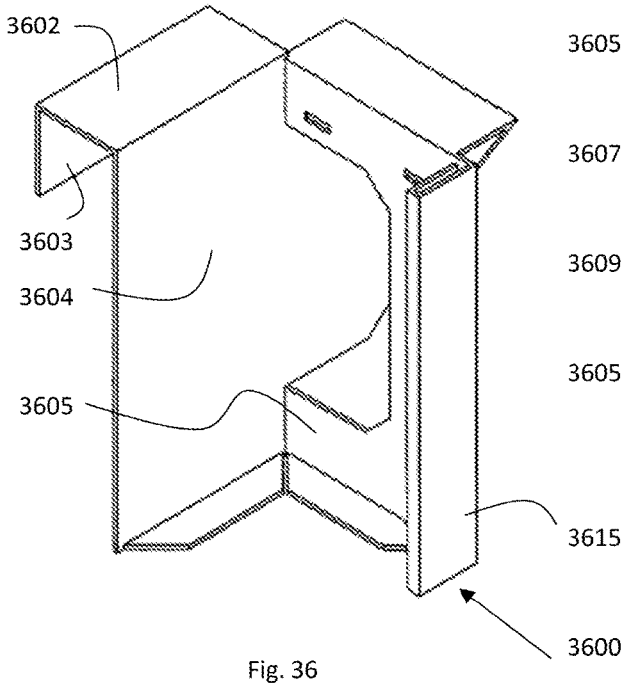
FIG. 36 is a rear perspective view of a bracket wherein a brace for the deck supporting ledge is connected to the sidewall.
Figure 37:
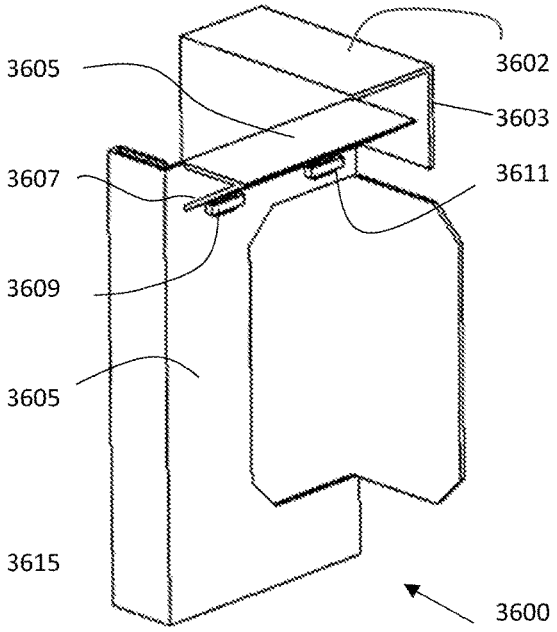
FIG. 37 is a side perspective view of the bracket of FIG. 36.
Figure 38:
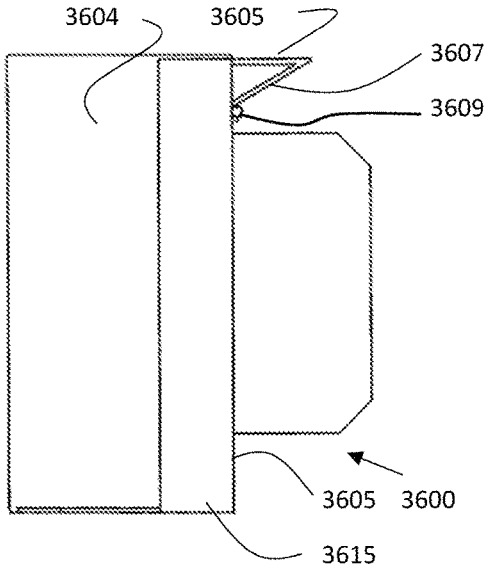
FIG. 38 is a rear view in elevation of the bracket of FIG. 36.
Figure 39:
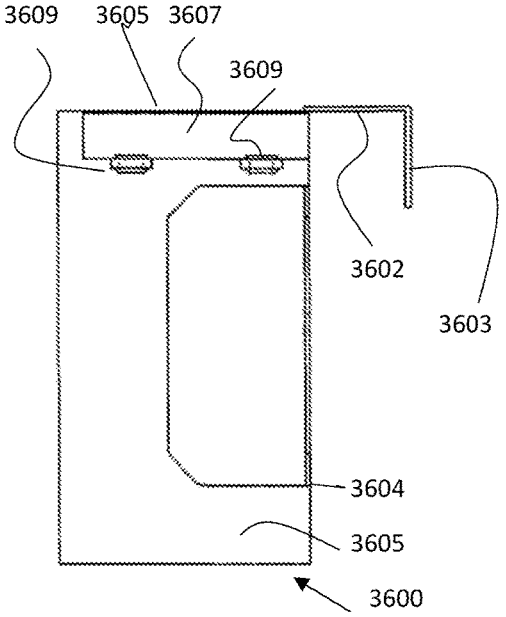
FIG. 39 is a side view in elevation of the of the bracket of FIG. 36.

The bracket 3400 depicted in FIG. 34 includes a deck support feature that is provided by support surface 3411 which extends from the top edge of side wall 3430. Support surface 3411 has an angled member 3413 that extends back towards side wall 3430. Bracket 3400 includes channel 3406 designed to receive a joist. Channel 3406 is defined by top member 3403 which extends horizontally from sidewall 3407 and side member 3405 that extends downward from top member 3403. In embodiments side member 3405 may be excluded and fasteners may be provided to allow horizonal part 3403 to engage the top surface of a joist. Like previous embodiments, bottom tabs 3409 and 3410 are provided to support the post during the construction process. In other embodiments, fasteners are provided to secure the posts to joists or other support structures. The part depicted in FIG. 34 also includes a modified hem 3415 that is created by folding part 3419 so it is parallel with part 3417 to define an elongate narrow groove. Referring now to FIG. 35, part 3500 is depicted that is designed to engage part 3400. Part 3500 has a hem that is complementary to the hem of part 3400 which is created by hem wall 3506 folded back against sidewall 3507. Hem wall 3506 of part 3500 is received in the slot or groove defined by hem wall 3417 and hem wall 3419 is received in bracket part 3400. Part 3500 also includes ledge 3502 that extends from sidewall 3507 and, in addition, a joist attachment structure made from parts 3515 and 3518. Ledges 3502 and 3411 are provided to support decking elements or planks that abut the assembled bracket.

FIGS. 36-39 depict one half of a bracket 3600 that includes top deck ledge member 3605 which is supported by a brace member 3607 that is connected to the sidewall 3605 of the bracket. Side wall 3605 has two projecting elements 3609 and 3611 that define slots and which receive complementary tang parts that extend from the end of bottom lateral edge of brace member 3607. Like the previous embodiment joist attachment member is provided on front wall 3604 that is made from sections 3502 and 3603. This embodiment also includes a modified hem 3615 designed to be attached to a second bracket part (not shown) to create a tubular member.

Even though numerous characteristics and advantages of the embodiment have been set forth in the foregoing description, together with details of the methods and systems and function of the embodiment, the disclosure is illustrative only, and changes may be made in detail, especially in the matters of the options, and arrangements of steps within the principles of the present disclosure to the full extent indicated by the broad general meaning of the terms in which the appended claims are expressed. For example, those skilled in the art will appreciated that present bracket may be sized to receive a 4"×4" posts or other dimensions may be used with or without notching the posts around joists or beams. The bracket can be used without or in conjunction with bolts or lag screws to further fasten the base of the posts to the face of the joist and can be used with other ties. In addition, the bracket can be used with wood blocking techniques to further counteract forces at post bottoms. While the present examples contemplate the use of posts and joists made from wood, other materials may also be used.

I claim:

1. A mounting bracket assembly for a post comprising two parts, a first bracket part defined by a first planar sidewall having a first lateral edge, a second lateral edge, a top edge and a bottom edge, said top edge having a top planar attachment member part extending perpendicular to said planar sidewall from a location between said first end and said second end of said top edge and having a length along said top edge the same as or less than the length of said top edge, and a second planar sidewall extending from said second edge in a perpendicular direction opposite the direction of said top planar part, said first bracket part further comprising a modified hem structure extending from a third lateral edge on said second sidewall, said hem structure further comprising a first hem planar part extending perpendicular to said second planar sidewall and a second planar hem part having a free end that extends back toward said second planar sidewall and said first and second hem parts define an elongate groove, and a second bracket part, said second bracket part comprising a first planar sidewall having a first lateral edge and a second lateral edge, and a second planar sidewall extending from said second lateral edge in a perpendicular direction with respect to said first sidewall, said second planar sidewall of said second bracket further comprising a second hem structure, said second hem structure further comprising a first hem planar part extending perpendicular to said second planar sidewall and a second planar hem part having a free end that extends back toward a rear surface of said second planar sidewall, and said first hem planar part and said second planar free end hem part define an elongate groove, wherein the free end part of said first bracket is received in said elongate groove of said second bracket and said free end hem part of said second bracket is received in said elongate groove of said first part, and said first and second bracket parts assembled to form a square tubular member.

2. The bracket assembly of claim 1 wherein and said second planar sidewall of said first bracket part further comprises a deck support ledge member perpendicularly extending from a top rim edge of said second planar sidewall and said support ledge member having a length along said top rim edge of said second planar sidewall, the same as or less than the length of said top rim edge.

3. The bracket assembly of claim 2 further comprising at least one tab member that extends from a bottom edge of at least one of said sidewalls of said first bracket part wherein said tab member is positioned to support a post in an assembled bracket.

4. The bracket assembly of claim 1 wherein said top planar attachment member attached to said first planar sidewall of said first bracket part has a further planar retention section that extends downward and parallel with said first planar sidewall and defines a slot.

5. The bracket assembly as recited in claim 2 wherein said deck support ledge member further comprises a brace member extending from a distal end of said deck support member back to said second planar sidewall.

6. The bracket as recited in claim 4 wherein at last at one said second sidewall of said first bracket part further comprises a projection from said surface and said brace member that extends from said distal edge of said deck support ledge member to said second sidewall is supported by said brace member which is supported by said projection.

7. A bracket for supporting a post comprising a tubular member, said tubular member comprised of four sidewalls and each said sidewall having a top rim edge, said top rim edge having a first end and a second end, and a bottom rim edge, and an attachment member having a first portion extending from a first one of said sidewalls in a direction perpendicular to said first sidewall and away from a central axis though said tubular member and a second planar portion extending from said attachment member downward and defining a plane that is parallel to said first sidewall, said attachment member and said first sidewall thereby defining an open U-shaped channel, and said attachment member extending from said top rim edge of said first sidewall from a location between said first end and said second end of said top rim edge and having a length along said top rim edge the same as or less than the length of said top rim edge, and a deck support ledge member perpendicularly extending from a top rim edge of a second sidewall to a distal edge and said deck support ledge member having a length along said top rim edge the same as or less than the length of said top rim edge, and at least one tab member extending from a bottom rim in a radial direction and towards said central axis from at least one sidewall.

8. The bracket recited in claim 7 further comprising a brace member that extends from said distal edge of said deck support ledge member to said second sidewall.

9. The bracket recited in claim 8, wherein said second sidewall comprises a projection from its surface and said brace member engages said projection, sidewall using a tang and slot arrangement.

10. The bracket recited in claim 8 wherein the said projection that extends from the side of said second sidewall forms a slot and said brace further comprises a tang that can be received in said slot.

11. The bracket as recited in claim 7 wherein said tubular member is comprised of two parts that are attached together.

12. The bracket recited in claim 7 wherein the two parts are attached to one another by modified hems, further comprising at least one tab member extending from a bottom rim of a sidewall in a radial direction and towards said central axis from at least one sidewall.

* * * * *